US009095735B2

(12) United States Patent
Kashmakov et al.

(10) Patent No.: US 9,095,735 B2
(45) Date of Patent: Aug. 4, 2015

(54) NOSE FILTER

(76) Inventors: Boris Kashmakov, Yafo (IL); Levi Tolmasov, Ramat Gan (IL); Arkady Tolmasov, Holon (IL)

( * ) Notice: Subject to any disclaimer, the term of this patent is extended or adjusted under 35 U.S.C. 154(b) by 1467 days.

(21) Appl. No.: 11/574,979

(22) PCT Filed: Apr. 26, 2006

(86) PCT No.: PCT/IL2006/000509

§ 371 (c)(1),
(2), (4) Date: Mar. 9, 2007

(87) PCT Pub. No.: WO2006/123323

PCT Pub. Date: Nov. 23, 2006

(65) Prior Publication Data

US 2007/0227542 A1 Oct. 4, 2007

Related U.S. Application Data

(60) Provisional application No. 60/681,843, filed on May 17, 2005.

(51) Int. Cl.
*A62B 23/06* (2006.01)

(52) U.S. Cl.
CPC ..... *A62B 23/06* (2013.01)

(58) Field of Classification Search
CPC ..... A61M 15/08; A62B 23/06
USPC ..... 128/206.18, 206.11, 200.24, 201.18, 128/203.22, 204.12, 205.27, 205.29, 128/207.13, 207.18, 204.11, 204.13, 206.21
See application file for complete search history.

(56) References Cited

U.S. PATENT DOCUMENTS

| | | | | | |
|---|---|---|---|---|---|
| 2,057,397 | A * | 10/1936 | Strauch | 128/204.13 |
| 2,433,565 | A * | 12/1947 | Korman | 128/204.12 |
| 2,526,586 | A * | 10/1950 | Shuff | 128/204.12 |
| 2,535,155 | A * | 12/1950 | Pandorf | 128/204.12 |
| 3,457,917 | A * | 7/1969 | Mercurio | 128/204.12 |
| 3,513,839 | A * | 5/1970 | Matthew | 128/204.12 |
| 3,747,597 | A * | 7/1973 | Olivera | 128/206.11 |
| 3,884,223 | A | 5/1975 | Keindl | |
| 5,425,359 | A | 6/1995 | Liou | |
| 5,890,491 | A * | 4/1999 | Rimkus | 128/206.11 |
| 6,109,262 | A * | 8/2000 | Tovey | 128/206.11 |
| 6,119,690 | A | 9/2000 | Pantaleo | |
| 7,156,098 | B2 * | 1/2007 | Dolezal et al. | 128/206.11 |
| 2004/0261791 | A1 * | 12/2004 | Horian | 128/200.24 |
| 2005/0211250 | A1 * | 9/2005 | Dolezal et al. | 128/206.11 |
| 2006/0150979 | A1 * | 7/2006 | Doshi et al. | 128/206.11 |

FOREIGN PATENT DOCUMENTS

WO PCT/IL06/00509 11/2006

* cited by examiner

*Primary Examiner* — Justine Yu
*Assistant Examiner* — LaToya M Louis
(74) *Attorney, Agent, or Firm* — Garcia-Zamor IP Law; Ruy M. Garcia-Zamor

(57) ABSTRACT

In one aspect, the present invention is directed to a nose filter adapted to be inserted into a nostril, the nose filter comprising: a housing having an external shape corresponding to the nostril, for enforcing breathed air to pass through the housing; filtering membrane(s), for filtering inhaled air; a first air passageway(s), through the filtering membrane(s); a second air passageway(s), bypassing the filtering membrane(s); and valve(s), for enforcing inhaled air to pass through the filtering membrane(s), and bypass the filtering membrane(s) upon exhalation; wherein the valve(s) are operative to block the second air passageway(s) upon inhalation, and operative to open the second passageway(s) upon exhalation.

5 Claims, 4 Drawing Sheets

NOSE FILTER

The current application is a 371 of PCT Application no. PCT/IL2006/000509, filed 26 Apr. 2006 which claims priority of U.S. Provisional application No. 60/681,843, filed 17 May 2005, whose disclosures are incorporated herein by reference.

FIELD OF THE INVENTION

The present invention relates to the field of air filters. More particularly, the invention relates to a nose filter.

BACKGROUND OF THE INVENTION

Prior attempts to provide a disposable respiratory nose filter generally fall within one of two categories: mask-style nose filters, i.e., those designed to cover the exterior of the nostrils of the nose; and, intrusive-style nose filters, i.e., those which are designed to be inserted into a nasal passageway.

U.S. Pat. No. 5,392,773 and the patents referenced therein generally disclose mask-like nose filters. Specifically, U.S. Pat. No. 5,392,773 discloses a mask-like filter, which includes a meshed filler region surrounded by an adhesive region. The adhesive region further includes tabs which adhere to the base, lateral and tip portions of the nose.

U.S. Pat. Nos. 3,774,601 and 4,984,302 disclose the use of cotton, wool, polyethylene or polyester as a material used to filter particulate in a Rose filter attached to the exterior of the nose. Both filters, however, cover a large portion of the face and can irritate the skin with which it comes in contact. Generally speaking, mask-like nose filters are extremely awkward, cumbersome and unsightly. Further, when mask-like nose filters become wet, they cling or stick to the face of the wearer, making it difficult to speak or breathe. Additionally, such nose filters lack aesthetic appeal. Intrusive-style nose filters are disclosed in U.S. Pat. Nos. 3,457,917, 3,905,335, 4,052,983, 5,417,205 and 5,568,808. U.S. Pat. No. 3,457,917 discloses a non-disposable nose filter which includes a filter retaining means (i.e., a housing), filtering material, and a detachable cap having finger gripping means provided at the end of the cap. Unlike the present invention, the filter retaining means in U.S. Pat. No. 3,457,917 is formed from a hard molded plastic such as polytetrafluorethylene or Bakelite.

U.S. Pat. No. 3,905,335 discloses a nasal air filter comprising a pair of interconnected cylinders having a filter material within. The cylinders further contain yieldable flange means which engage the inner nostril walls. U.S. Pat. No. 4,052,983 discloses a filter device insertable into the nasal passages which include a pair of flexible casings, each casing releasable receives a filter cartridge. The filter cartridges have a multitude of cilia-like, nylon filaments which act to electrostatically charge the air as it moves past the filaments, thus aiding in the filtering process.

U.S. Pat. No. 5,417,205 discloses an air filter comprised of two filter units linked by a connecting element. Each filter unit further comprises first and second gauze filters and a plurality of rods extending from the first gauze filter to the second gauze filter and retaining a stack of wet filter cloth between the gauze filters.

U.S. Pat. No. 5,568,808 discloses an air filter generally comprised of housing, a filter component and a flutter valve. Upon inhalation the flutter valve forms a seal with the lower external portion of the nostril forcing air to pass through the filter component. Upon exhalation the seal between the flutter valve and the external portion of the nostril is broken, allowing air to escape through the area between the housing and the inner nostril wall. If such an air filter is used with an overabundance of medicant (i.e., a medicinal substance) or aqueous solutions, the broken seal would allow the medicant or solutions to escape from the nostril.

An improved nose filter in accordance with the present invention eliminates the drawbacks and inconvenience of the prior nose filters described above.

SUMMARY OF THE INVENTION

In one aspect, the present invention is directed to a nose filter adapted to be inserted into a nostril, the nose filter comprising:

a housing 10 having an external shape corresponding to the nostril, for enforcing breathed air to pass through the housing;

filtering membrane(s) 30, for filtering inhaled air;

a first air passageway(s) 31, through the filtering membrane(s);

a second air passageway(s) 32, bypassing the filtering membrane(s);

and valve(s), for enforcing inhaled air to pass through the filtering membrane(s) 30, and bypass the filtering membrane(s) upon exhalation; wherein the valve(s) are operative to block the second air passageway(s) 32 upon inhalation, and operative to open the second passageway(s) 32 upon exhalation.

In another aspect, the present invention is directed to a nose filter adapted to be inserted into a nostril, the nose filter comprising:

a housing 10 having an external shape corresponding to the nostril, for enforcing breathed air to pass through the housing;

filtering membrane(s) 30, for filtering inhaled air; and valve(s), for enforcing inhaled air to pass through the filtering membrane(s), and bypass the filtering membrane(s) upon exhalation, the at least one valve comprises a seal 22, the seal being movable upwards upon inhalation, thereby closing the second air passageway(s) 32, and movable downwards upon exhalation, thereby opening the second air passageway(s) 32.

According to a preferred embodiment of the invention each of the valves comprises of a cavity 38 and a flexible cover 39 attached to the lower side of the cavity.

Preferably the housing includes upper cavities 11 and bottom cavities 12. The filtering membranes 30 are disposed therebetween.

According to a preferred embodiment of the invention, the external shape of the housing 10 conforms to the shape of a nostril passageway, and the dimensions of the external side of the housing 10 are greater than the dimensions of the nostril, thereby sealing the nose air passageway in order to enforce breathed air to pass through the nose filter.

According to a preferred embodiment of the invention, the shape of the housing conforms to the shape of a nasal passage, thereby preventing irritating the sensitive inner wall of the nostril into which the filter is inserted.

Preferably the nose filter is not exposed from the nostril thereof, thereby resulting with aesthetically pleasing form.

The housing may be formed from flexible material as well as from a rigid material.

The filtering membrane may comprise one or more filtering layers. In case of a plurality of filtering layers, each layer may have a different filtering characteristic.

In yet another aspect, the present invention is directed to a method for filtering air passing through a nostril, the method comprises the steps of: providing one or more filtering membranes, for filtering air; redirecting inhaled air to the nostril to pass through the air filtering membranes; and redirecting exhaled air from the nostril to bypass the air filtering membranes.

The nose filter may filter dust, germs, allergic matter, or other foreign particulate from the air passing through the nostrils into the sinus cavity. It has been found that as the air passes through the filter, the air is also warmed before it reaches the sinus cavity and eventually the lungs.

The nose filter also moisturizes the mucous membranes of the sinus cavity and prevents dryness or irritation due to pollen, smoke, industrial chemicals, perfumes, dust, mold, and other allergenic.

Other advantages and aspects of the present invention will become apparent upon reading the following description of the drawings and detailed description of the invention.

BRIEF DESCRIPTION OF THE DRAWINGS

The present invention may be better understood in conjunction with the following figures.

DETAILED DESCRIPTION OF PREFERRED EMBODIMENTS

Figure 1A:
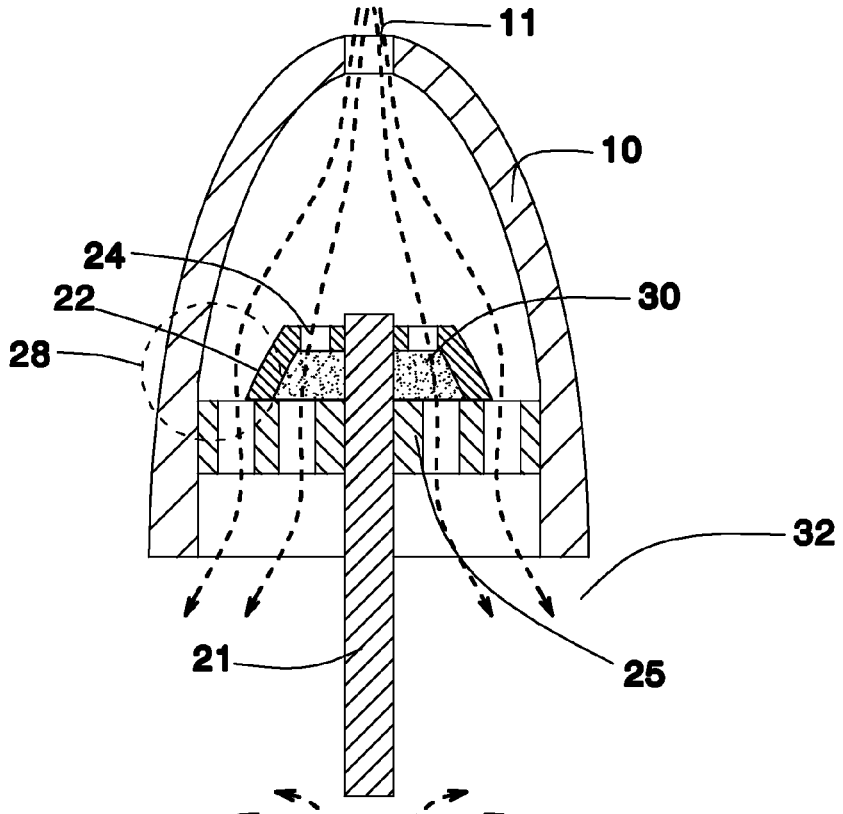
FIG. 1A illustrates the nose filter during exhalation time.

While this invention is adaptable to many different forms, there is shown in the drawings and will herein be described in detail a preferred embodiment, with the understanding that the present disclosure is to be considered as an exemplification of the principles of the invention and is not intended to limit the broad aspect of the invention to the embodiments illustrated.

Figure 1B:
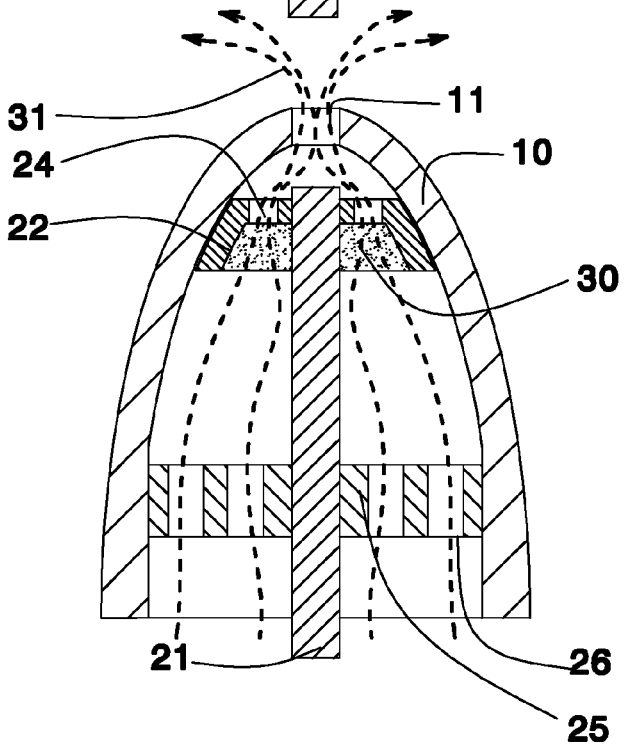
FIG. 1B illustrates the nose filter during inhalation time.
Figure 2:
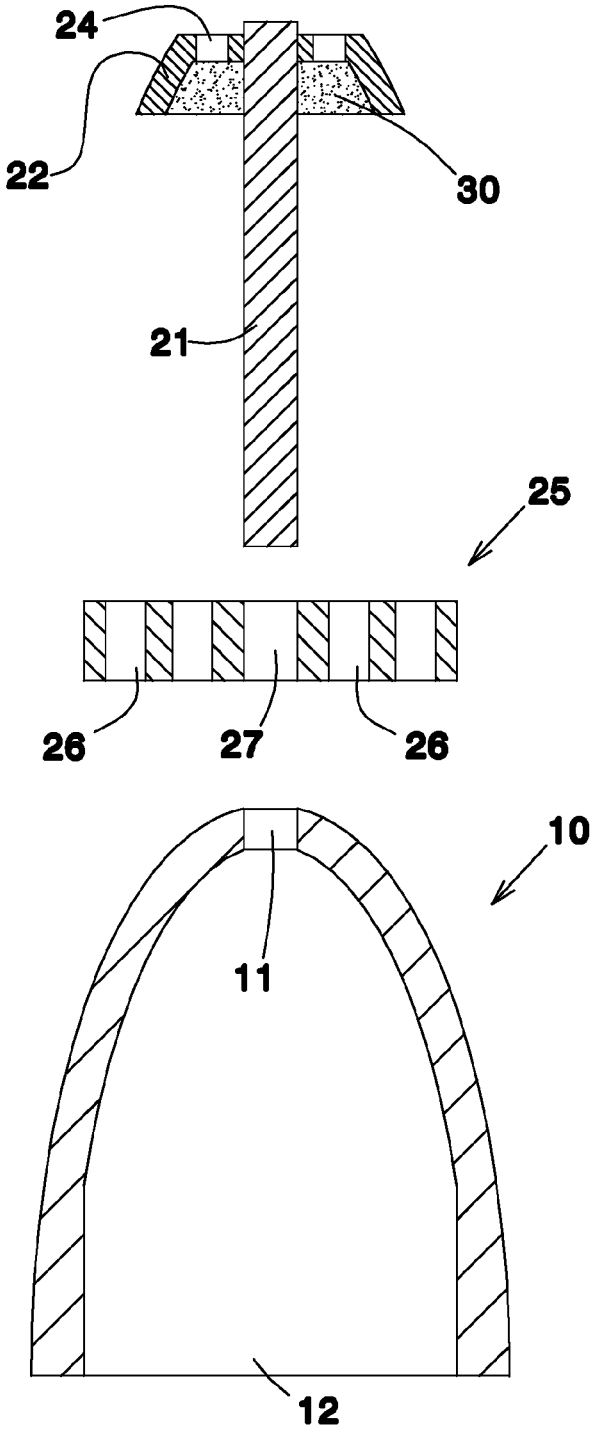
FIG. 2 illustrates the parts of the nose filter, according to one embodiment of the invention.

Each of FIGS. 1A, 1B and FIG. 2 is a cross-section of a nose filter, according to one embodiment of the invention.

FIG. 1A illustrates the nose filter during exhalation time, and FIG. 1B illustrates the nose filter during inhalation time.

FIG. 2 illustrates the parts of the nose filter, according to one embodiment of the invention.

The nose filter comprises: a housing 10, a valve (comprising elements 21, 24, and 25 in the figures) and a filtering membrane 30.

The housing 10 comprises an upper cavity 11, and a lower cavity 12. The air passes through the cavities while the wearer thereof breathes.

In the embodiments illustrated in FIG. 1A, FIG. 1B and FIG. 2, the valve comprises an axle 21, and a seal (obturator) 22 to which the filtering membrane 30 (a filtering substance) is attached. The axle 21 is movable through cavity 27 of an adherent 25, which is attached to the housing 10. The adherent 25 comprises one or more cavities 26 for enabling inhaled and exhaled air to pass through adherent 25.

Upon inhaling, as illustrated in FIG. 1B, the inhaled air pushes the seal 22 upward to the narrow portion of housing 10 until stopped by housing 10, thereby closing the air passage 28 and forcing inhaled air to pass through the filtering membrane 30. Upon exhaling, as illustrated in FIG. 1A, the exhaled air pushes the seal 22 downward until stopped by the adherent 25, thereby opening an air passage 28 between the seal 22 and the housing 10, through which the air passes out.

The seal 22 must have one or more cavities 24, through which air can pass through the seal 22.

Figure 3A:
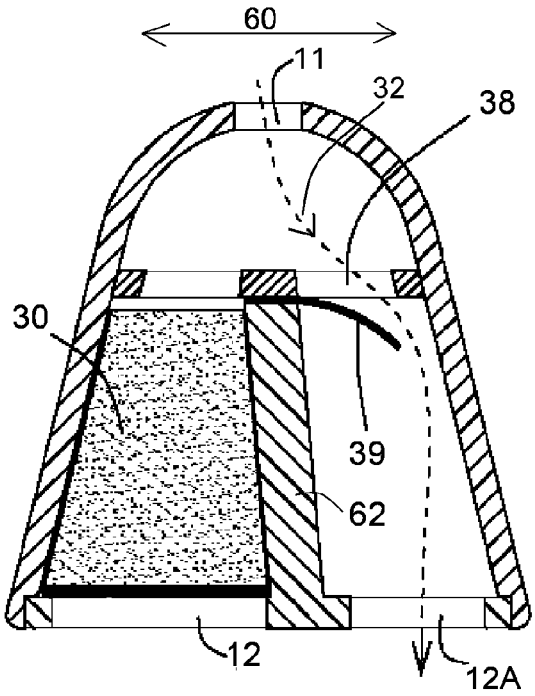
FIG. 3A is a cross-section of a nose filter while exhaling, according to a preferred embodiment of the invention.

FIG. 3A is a cross-section of a nose filter while exhaling, according to a preferred embodiment of the invention.

Figure 3B:
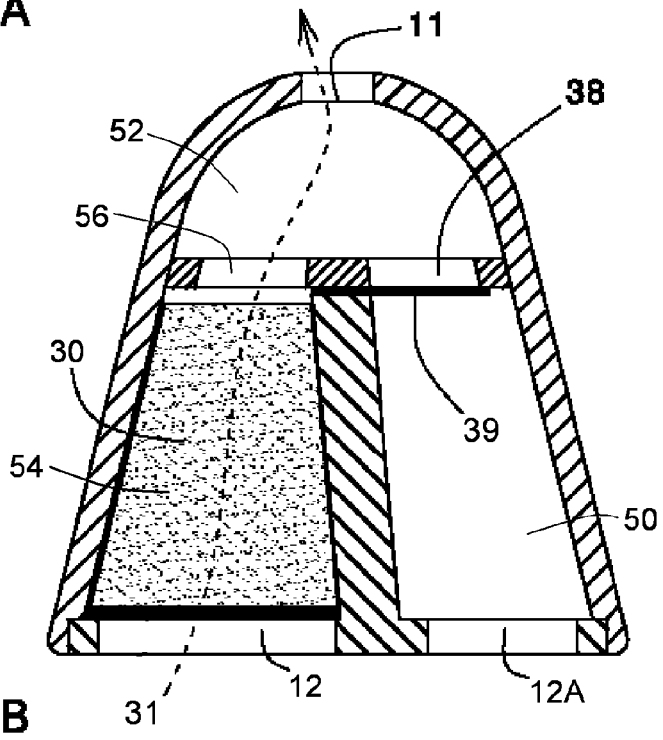
FIG. 3B is a cross-section of a nose filter while inhaling, according to a preferred embodiment of the invention.

FIG. 3B is a cross-section of a nose filter while inhaling, according to a preferred embodiment of the invention.

Referring to FIGS. 3A and 3B, housing 10 comprises upper cavity 11, and lower cavities 12 and 12A. Housing 10 includes a first lower cell 54 containing a stationary filtering membrane 30; a second lower cell 50; and an upper cell 52. A substantial portion 60 of the upper cell 52 is vertically aligned with the lower cells 50 and 54. A center wall 62 separates the lower cells 50 and 54. The first lower cell 54 includes a lower cavity 12 and a top passageway 56. The second lower cell 50 includes a lower cavity 12A and a top passageway 38. The bottom of upper cell 52 includes passageways 56 and 38; and the top of upper cell 52 includes upper cavity 11. The valve comprises an air passageway 38 and an elastic cover thereof 39, which covers the bottom of the passageway 38. In its "normal" state, the elastic cover 39 covers the air passageway 38. On exhalation, when the air 32 passes downwards, the elastic cover 39 bends thereby allowing the air 32 to pass through the passageway 38, through lower cell 50, down to lower cavity 12A, as illustrated in FIG. 3A. On inhalation, when the inhaled air 31 passes upwards, the elastic cover 39 blocks the passageway 38, thereby forcing the inhaled air 31 to pass through the stationary filtering membrane 30, as illustrated in FIG. 3B. The elastic cover 39 blocks the exhaled air, left within housing 10 below passageway 38, from returning by the inhaling, into cavity 11 and into the nostril. The normal state of the elastic cover 39 is illustrated in FIG. 3B. In this state the cover 39 covers the entire passageway 38.

As a result, the nose filter of the present invention is less constraining and more readily simulates normal breathing by the wearer.

Figure 4:
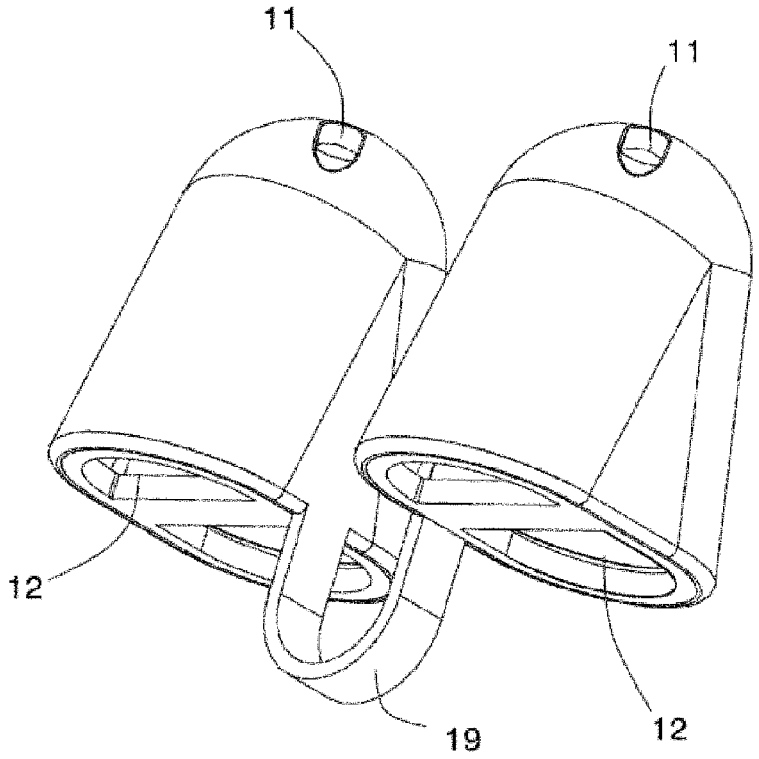
FIG. 4 schematically illustrates a nose filter, according to a preferred embodiment of the invention.

FIG. 4 schematically illustrates a nose filter, according to a preferred embodiment of the invention. It includes two nose filters, one for the left nostril and one for the right nostril. The left and the right nose filters are connected by a flange 19, being disposed below and outside housings 10 of the nose filters. The disposition of elastic cover 39 within housing 10 and not outside housing 10 enables disposing flange 19 outside housing 10.

The housing 10 may be formed of flexible or rigid material. In a preferred embodiment of the present invention, any plastic or rubber-like material which is non-toxic and which will not irritate the inner wall of the nostril may be used to form the housing. The housing 10 may be formed also from synthetic rubber latex. However, the present invention also contemplates embodiments wherein the housing comprises natural porous filtering material, such as activated carbon, cotton, linen, gauze or the like. It has been found that when the housing is formed from a plastic or rubber-like material arid and the nose filter is inserted into the nostril, the housing 10 also aids in forcing the nasal passageway open, thus allowing more air to pass through the nose filter and into the sinus cavity.

When the nose filters of the present invention are not in use, they may be kept in a convenient container filled with a saline or other aqueous solution to retain moisture of the filter component. It will also be understood that the size and shape of the nose filters of the present invention may be varied to accommodate noses of different sizes and shapes.

While the specific embodiment has been illustrated and described, numerous modifications come to mind without markedly departing from the spirit of the invention. The scope of protection is only intended to be limited by the scope of the accompanying claims.

The filtering membrane 30 may comprise a plurality of layers, each of a different filtering material, thereby allowing a plurality of filtering characteristics. In all of the embodiments of the present invention, any suitable material such as cotton, activated carbon or a cellulose material may be used to form the filtering membrane. However, in a preferred embodiment, the filtering membrane consists of an absorbent material, such as activated carbon. The filtering membrane may further be soaked in a saline solution, herbal or vitamin oil, medicant or any aqueous solution. For example, the nose filters of the present invention may be moistened with a nose drop spray, medicant or aqueous solution, even when the filter is inserted in the nostril.

The nose filter may be operative for filtering dust, germs, allergic matter, or other foreign particulate from the air passing through the nostrils into the sinus cavity. It has been found that as the air passes through the filter, the air is also warmed before it reaches the sinus cavity and eventually the lungs.

The nose filter can be designed to easily inserted and removed from the nostril, and which will conform to the shape of the nasal passageway without irritating the sensitive inner wall of the nostril.

Those skilled in the art will appreciate that the invention can be embodied in other forms and ways, without losing the scope of the invention. The embodiments described herein should be considered as illustrative and not restrictive.

The invention claimed is:

1. A nose filter adapted to be inserted into a nostril, the nose filter comprising:

a housing having an external narrowing shape for allowing breathed air to pass through said housing, said housing comprising:

first and second lower cavities disposed at a bottom of said housing;

an upper cavity disposed at a top of said housing;

a first stationary lower cell comprising said first lower cavity and a first aperture forming a first passageway;

a second stationary lower cell disposed aside said first lower cell, said second lower cell comprising said second lower cavity and a second aperture forming a second passageway; and a stationary upper cell disposed above said first and second lower cells, said stationary upper cell comprising said first and second passageways and said upper cavity; thereby forming substantially a straight air path between said upper cavity and said first lower cavity, and substantially another straight air path between said upper cavity and said second lower cavity;

at least one stationary filtering membrane disposed within said first lower cell, for filtering air; and at least one valve, for blocking exhaled air remaining in the second lower cell from flowing back into the upper cell when closed, and to allow exhaled air to flow out from the upper cell into the second lower cell when open, wherein said at least one valve is operative to block said second air passageway upon inhalation, and operative to open said second passageway upon exhalation, and wherein said at least one valve comprises a flexible cover attached to the lower side of said second air passageway, and wherein said second stationary lower cell and said upper cell are empty of a filtering membrane, and wherein said housing is formed from a flexible material, and a substantial portion of the upper cell is directly above and vertically aligned with said first and second lower cells, and a center wall separating the first and second lower cells is vertically aligned with said upper cavity, thereby said stationary upper cell disposed above said first and second lower cells and comprising a portion of a length of said housing, is conformable; and thereby said at least one valve blocks exhaled air, being left within said second lower cell, from returning into the nostril upon inhaling, and thereby the disposition of said at least one valve within said housing provides space for disposing a flange outside said housing, for connecting said nose filter to another nose filter.

2. A nose filter according to claim 1, wherein the shape of said housing is adapted to conform to the shape of a nasal passage, thereby preventing irritation of a sensitive inner wall of said nostril into which said filter is inserted.

3. A nose filter according to claim 1, wherein said nose filter is sized and shaped and adapted to be not exposed from the nostril.

4. A nose filter according to claim 1, wherein said at least one filtering membrane comprises at least one filtering layer.

5. A nose filter according to claim 1, wherein said at least one filtering layer comprises at least two filtering layers, each layer comprising a different filtering characteristic.

* * * * *